US012130048B2

(12) United States Patent
Khalil

(10) Patent No.: US 12,130,048 B2
(45) Date of Patent: Oct. 29, 2024

(54) SOFFIT VENT

(71) Applicant: Anneliese Khalil, Franklinville, NJ (US)

(72) Inventor: Anneliese Khalil, Franklinville, NJ (US)

( * ) Notice: Subject to any disclaimer, the term of this patent is extended or adjusted under 35 U.S.C. 154(b) by 0 days.

(21) Appl. No.: 15/884,525

(22) Filed: Jan. 31, 2018

(65) Prior Publication Data

US 2018/0156482 A1 Jun. 7, 2018

Related U.S. Application Data

(63) Continuation-in-part of application No. 14/739,916, filed on Jun. 15, 2015, now Pat. No. 10,731,891.

(60) Provisional application No. 62/011,748, filed on Jun. 13, 2014.

(51) Int. Cl.

| | |
|---|---|
| ***F24F 7/08*** | (2006.01) |
| ***F24F 7/00*** | (2021.01) |
| ***F24F 7/04*** | (2006.01) |
| ***F24F 13/02*** | (2006.01) |

(52) U.S. Cl.

CPC ..... *F24F 7/08* (2013.01); *F24F 7/04* (2013.01); *F24F 13/0236* (2013.01); *F24F 2007/001* (2013.01); *F24F 2007/002* (2013.01)

(58) Field of Classification Search

CPC .... F24F 7/08; F24F 13/0236; F24F 2007/001; F24F 2007/002; F24F 7/04

USPC ..... 454/14, 22, 52, 64, 167, 241, 243, 245, 454/248, 250, 252, 270, 275, 305, 306, 454/903, 354

See application file for complete search history.

(56) References Cited

U.S. PATENT DOCUMENTS

| | | | | |
|---|---|---|---|---|
| 3,051,071 A | | 8/1962 | Leigh | |
| 4,750,411 A | * | 6/1988 | Eversole | F24F 13/0236 138/162 |
| 5,095,942 A | * | 3/1992 | Murphy | F16L 9/003 137/561 A |
| 5,167,578 A | | 12/1992 | Legault | |
| 5,341,767 A | * | 8/1994 | Smith | F23C 7/00 122/13.01 |
| 5,791,985 A | * | 8/1998 | Schiedegger | F24F 7/02 454/339 |
| 5,855,510 A | * | 1/1999 | McKenzie | A62C 2/24 454/342 |

(Continued)

OTHER PUBLICATIONS

George Awad, 4" Under Eave Vent, Lambro, https://www.lambro.net/wp-content/uploads/2017/01/143W.pdf (Year: 2013).*

(Continued)

*Primary Examiner* — Steven B McAllister
*Assistant Examiner* — Charles R Brawner
(74) *Attorney, Agent, or Firm* — Lorri W. Cooper; Cooper & Maersch LLC

(57) ABSTRACT

A soffit vent for dispersing moist air. The soffit vent can receive moisture through an interface unit which is connected to an elbow unit. The elbow unit is constructed to guide the moisture into an extension unit. The extension unit then leads the moisture to an outdoor area through an end unit. A flap unit is disposed between the extension unit and the end unit to prevent a backdraft of moisture. The end unit has a plurality of fixed baffles that are oriented upwardly to direct moisture upward and away from a building.

20 Claims, 6 Drawing Sheets

(56) References Cited

U.S. PATENT DOCUMENTS

| | | | | |
|---|---|---|---|---|
| 5,934,362 | A | 8/1999 | Blaine | |
| 5,984,776 | A * | 11/1999 | Berger | F24F 13/085 454/290 |
| 6,767,281 | B2 | 7/2004 | McKee | |
| 7,022,011 | B1 * | 4/2006 | Rickman | F24F 13/02 454/306 |
| 7,108,600 | B1 * | 9/2006 | Krzyskowski | F24F 13/02 454/292 |
| 7,410,416 | B2 * | 8/2008 | Fettkether | F24F 13/0218 454/265 |
| 9,062,454 | B1 | 6/2015 | Borgman et al. | |
| 9,341,291 | B2 * | 5/2016 | Sandman | F24F 13/10 |
| 9,657,962 | B2 * | 5/2017 | Mosley | F24F 13/08 |
| 10,731,891 | B2 | 8/2020 | Khalil | |
| 2006/0240762 | A1 * | 10/2006 | Railkar | E04D 13/152 454/260 |
| 2010/0124877 | A1 * | 5/2010 | Sukup | A01F 25/22 454/174 |
| 2011/0312262 | A1 * | 12/2011 | Grandmaison | F24F 13/084 454/276 |
| 2012/0052792 | A1 | 3/2012 | Sinur et al. | |
| 2013/0247480 | A1 | 9/2013 | Ridgway | |
| 2019/0195520 | A1 * | 6/2019 | King, Jr. | F24F 7/02 |

OTHER PUBLICATIONS

Vortex Flow Control Vent.

* cited by examiner

SOFFIT VENT

CROSS REFERENCE TO RELATED APPLICATIONS

This application claims the benefit of U.S. Non-Provisional application Ser. No. 14/739,916 filed on Jun. 15, 2015 which claims the benefit of U.S. Provisional Application No. 62/011,748 filed on Jun. 13, 2014. The above identified patent applications are herein incorporated by reference in its entirety to provide continuity of disclosure.

BACKGROUND OF THE INVENTION

The present invention relates to bathroom ventilation. More specifically, the present invention pertains to an improved soffit vent that allows moist air to be dispersed outdoors.

A bathroom exhaust fan draws in airborne moisture before it can cause damage or harm. During a bath or shower, if not removed promptly, the moisture can condense on bathroom floors and make them dangerously slippery. Airborne moisture condensing on walls can encourage the growth of bacteria, mold and mildew that can cause bathroom odors and pose a potential health risk. In addition, long-term exposure to excess moisture and humidity can cause bathroom odors and is a potential health risk. Additionally, long-term exposure to excess moisture and humidity can crack and peel paint and wallpaper, ruin wallboard, warp doors, and rust cabinets and fixtures. Furthermore, excess moisture that escapes into an attic can cost significant damage to the structure of a house or a roof.

Generally, a bathroom exhaust fan always exhausts to an outdoor area. A typical venting option includes running a duct up through the roof or down through the soffit. However, a typical soffit vent disperses the warm, moist air down through the soffit area, and then is drawn back into the attic due to the ambient air flow. Thereby, the potential of mold in the attic, causing significant harm, is introduced. In the alternative, venting through a roof is also contrary to a homeowner's needs. Venting through a roof will cause condensation to run back down into the fan housing, causing it to rust, and wetting the surrounding insulation and ceiling finishes. Therefore, there exists a need for an improved soffit vent that prevents warm, moist air from being drawn back through the soffit vent.

SUMMARY OF THE INVENTION

In view of the foregoing disadvantages inherent in the known types of soffit vents now present in the prior art, the present invention provides a new and improved soffit vent wherein the same can be utilized for preventing warm, moist air from being drawn back through the same.

The present invention provides a soffit vent that is mounted on to an eave of a roof and disperses air outward from a house through an end cap having upwardly pointed baffles and a downwardly pointed end cap. The soffit vent includes an elbow unit defining a cavity with an open upper end configured to correspond with an interface unit. The interface unit is configured to receive warm, moist air. A tubular extension unit extends outwardly from the elbow unit and is configured to receive warm, moist air that accumulates in the elbow unit after being received by the interface unit. A flap unit is hingably disposed between the elbow unit and the extension unit and is configured to enable an air flow through the extension unit while preventing backdraft into the elbow unit. An end unit is disposed on the extension unit opposite of the elbow unit and is configured to release warm, moist air into an outdoor environment.

It is therefore an object of the invention to provide a new and improved soffit vent that has all of the advantages of the prior art and none of the disadvantages.

Another object of the present invention is to provide a drip tongue disposed on the elbow and extending downwardly to release moisture buildup in the soffit vent. In one embodiment, a plurality of walls of the elbow are shaped to guide condensation towards the drip tongue.

A further object of the present invention is to provide an interface unit that is fastened to the elbow unit and configured to receive warm, moist air from a bathroom exhaust fan.

Yet another object of the present invention is to provide an extension unit that is configured to be customizable in size and shape by a user. In one embodiment, the extension unit contains a plurality of prefabricated ridges configured to enable a user to cut a plurality of extension unit portions from the extension unit to adjust the length of the soffit vent.

Still yet another object of the present invention is to provide a plurality of barriers within the elbow unit that are configured to prevent the flap unit from allowing backdraft.

A further object of the present invention is to provide an end cap that is removable to provide for easy maintenance and cleaning. In one embodiment, the end cap is comprised of a frame wherein a plurality of fixed baffles run parallel on a horizontal plane and are angled upward.

Still yet another object of the present invention is to provide an end unit that is configured to be attached by a fastener to the underside of an eave of a roof.

Other objects, features, and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
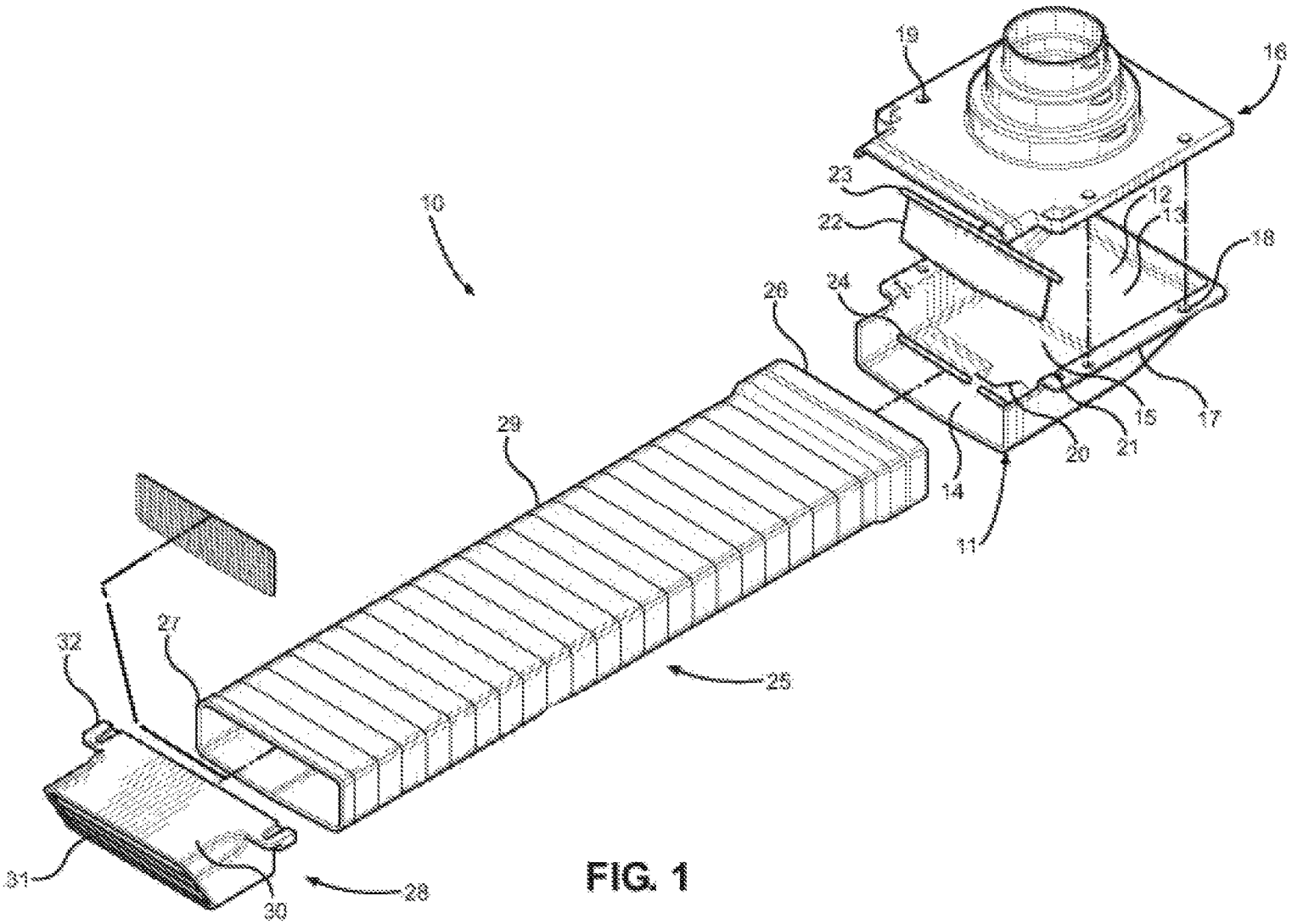
FIG. 1 shows an exploded view of an embodiment of the soffit vent.

Reference is made herein to the attached drawings. Like reference numerals are used throughout the drawings to depict like or similar elements of the soffit vent. The figures are intended for representative purposes only and should not be considered to be limiting in any respect.

Referring now to FIG. 1, there is shown an exploded view of the soffit vent 10. An elbow unit 11 is comprised of a housing 12 wherein the housing 12 has an inlet portion 13 and an outlet portion 14 defining a cavity 15 having an open upper end. The elbow unit 11 is configured to receive warm, moist air from an intake mechanism and release the warm, moist air outward towards an outflow segment.

An interface unit 16 is attached to the elbow unit 11 by a plurality of fasteners. The interface unit 16 is configured to receive warm, moist air from any source of warm, moist air. In one embodiment, the interface unit 16 is configured to receive warm, moist air from an exhaust fan. The open upper end of the cavity 15 is configured to receive the interface unit 16. In one embodiment, the elbow unit 11 has a lip 17 extending outwardly around the inlet portion 13. Under this embodiment, the lip 17 further comprises a plurality of apertures 18 configured to receive a fastener. Furthermore, the interface unit 16 comprises a plurality of corresponding apertures 19 configured to align with the plurality of apertures 18 of the elbow unit, such that a pair of aligned apertures can receive a fastener therethrough in order to secure the elbow unit 11 to the interface unit 16.

The elbow unit 11 is configured to receive a flap unit 22 between the elbow unit 11 and the interface unit 16. In one embodiment, the elbow unit 11 has a plurality of flap wells 21 in the lip 17 on the outlet portion 14 configured to receive a plurality of flap tabs 23 attached opposite each other on a top portion of the flap unit 22. The flap tabs 23 are configured to be movable within the flap wells 21 to allow the flap 22 to rotate around an axis defined thereby.

The flap unit 22 is configured to be movable in one direction, while preventing movement in an opposite direction. In one embodiment, there are a plurality of barriers 24 on the elbow unit 11 between the housing 12 and the flap unit 22 configured to prevent the flap unit 22 from being movable in a way that would allow backdraft into the elbow unit 11. In one embodiment, the barriers extend upward from a bottom surface of the elbow unit 11 opposite of an extension unit 25.

The extension unit 25 is attached to the elbow unit 11 at the outlet portion 14 wherein the flap portion 22 rests between the extension unit 25 and the elbow unit 11. The extension unit has a first end 26 and a second end 27 wherein the first end 26 is configured to slidably attach to the elbow unit 11. The second end 27 is configured to slidably receive an end unit 28 therein. The end unit 28 is configured to rest frictionally over the second end 27. The extension unit 25 is configured to receive moisture from the elbow unit 11 and further direct the moisture away from the interface unit 16.

In one embodiment, the extension unit 25 contains a plurality of prefabricated ridges 29 that separate the extension unit into a plurality of segments. Each prefabricated ridge 29 of the plurality of prefabricated ridges 29 is configured to enable the user to remove one or more segments of the extension unit thereof with a cutting device in order to fit into a desired location. In one embodiment, the prefabricated ridges are equally spaced from one another and define a predetermined distance. This allows a user to remove segments without the additional need for a measuring tool, such as a tape measure.

In another embodiment, the extension unit 25 is made of a flexibly movable material. This embodiment will enable a user to bend or adjust the path of the extension unit 25 as needed to properly orient the soffit vent to release the warm, moist air and condensation properly away from the building. Furthermore, under another embodiment, the prefabricated ridges 29 are configured to be foldable in order to assist the user in placing the extension unit 25 into a bent or flexed position The end unit 28 is comprised of an end housing 30 defining an end unit chamber and an end cap 31 configured to release warm, moist air into an outdoor environment. The end cap 31 acts as a termination point for the warm, moist air and is shaped to fit into the end unit 28. In one embodiment, the end cap 31 is angled downward away from a top surface of the end unit. In a further embodiment, the end cap 31 is removable from the soffit vent 10 to enable a user to clean the end unit chamber in the event that outdoor particulate matter or excess condensation builds up therein.

Under one embodiment, the end unit 28 contains a plurality of slidable fastener interfaces 32 extending outwardly from opposite ends on a top surface thereof. The slideable fastener interfaces 32 are configured to slide onto a fastener attached to an underside of an eave of a roof. Under this embodiment, the end unit 28 sits flush with a gutter line and will always be partially protected from outdoor elements because of its location under the eave of the roof. In the illustrated embodiment, a pair of fastener interfaces 32 are disposed on opposing ends of the end unit 28. Each fastener interface 32 comprises a slot that extends beyond the lateral sides of the end unit 28.

Figure 2:
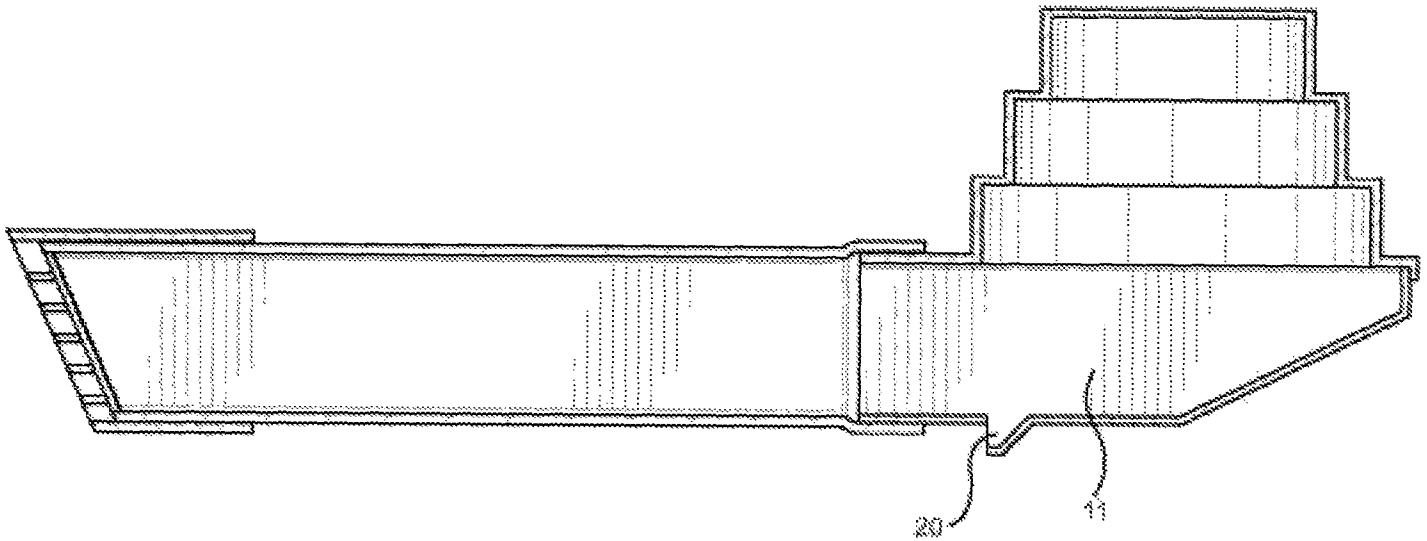
FIG. 2 shows an internal side view of an embodiment of the soffit vent.

Referring now to FIG. 2, there is shown an internal side view of an embodiment of the soffit vent. In one embodiment, the elbow unit 11 further comprises a drip tongue 20. The drip tongue 20 is located centrally on a bottom surface of the elbow unit wherein the drip tongue is comprised of an extension from the elbow unit 11 with a hole therein. The drip tongue 20 is configured to be an immediate egress point for condensation wherein condensation will build up in the extension and drip through the hole thereof. In cold climates, this embodiment is designed to prevent condensation build up that can eventually lead to damage caused by freezing. In a further embodiment, the elbow unit 11 is composed of a plurality of side walls. Each side wall of the plurality of side walls is pitched towards the drip tongue. This embodiment is configured to promote more efficient egress of condensation from the elbow unit. The evacuation of condensation by the drip tongue 20 is useful in cold environments as it prevents ice damming from forming on the soffit vent.

Figure 3:
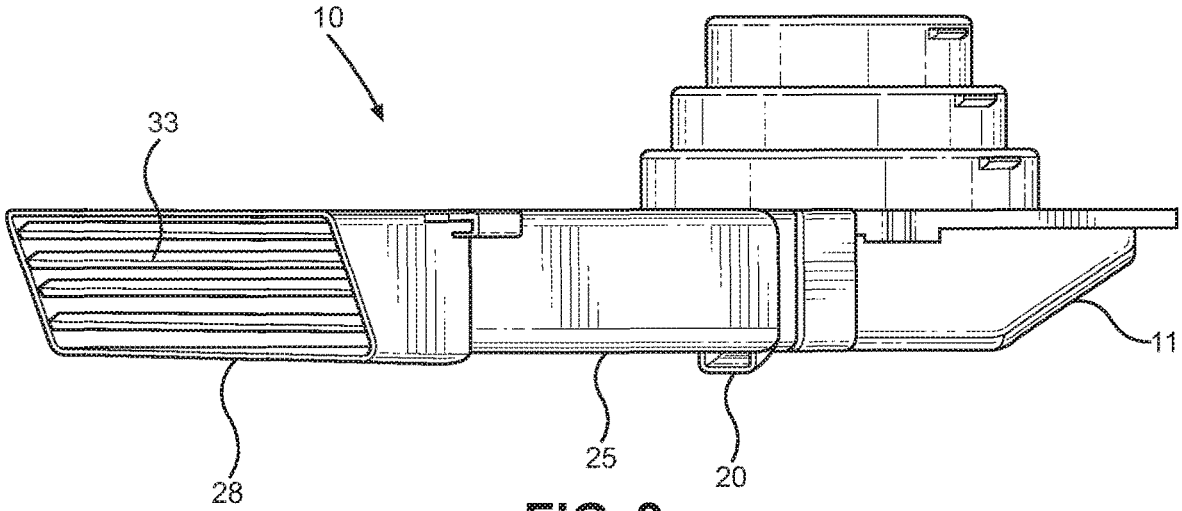
FIG. 3 shows a side perspective view of an embodiment of the soffit vent.

Referring now to FIG. 3, there is shown a side perspective view of an embodiment of the soffit vent. Under this embodiment, the end cap contains a plurality of parallel baffles 33 on a horizontal plane. The plurality of parallel baffles 33 are angled towards the upper surface of the end cap. This arrangement ensures that the warm, moist air is directed upwardly and outwardly relative to a building equipped with the soffit vent 10. Furthermore, the plurality of parallel baffles 33 is also configured to prevent backdraft and to prevent large animals from entering the soffit vent.

In one embodiment, there is a mesh screen disposed between the end unit and the extension unit 25. Under this embodiment, the mesh screen is configured to prevent insects and other small pieces of particulate matter from entering the soffit vent from an outdoor environment. Furthermore, the mesh screen is configured to have no negative impact upon a static pressure level inside of the soffit vent.

In one embodiment, the interface unit 16 further comprises an interface adapter 34. The interface adapter 34 is designed to receive an input duct wherein the input duct with transport warm, moist air into the soffit vent. In one embodiment, the interface adapter 34 is a tubular unit configured to receive a ventilation duct and to form an airtight seal therewith. In the illustrated embodiment, the interface adapter is comprised of a plurality of tiered tubular units wherein each tiered tubular unit is configured to receive a ventilation duct thereon to form an airtight seal therewith.

Figure 4:
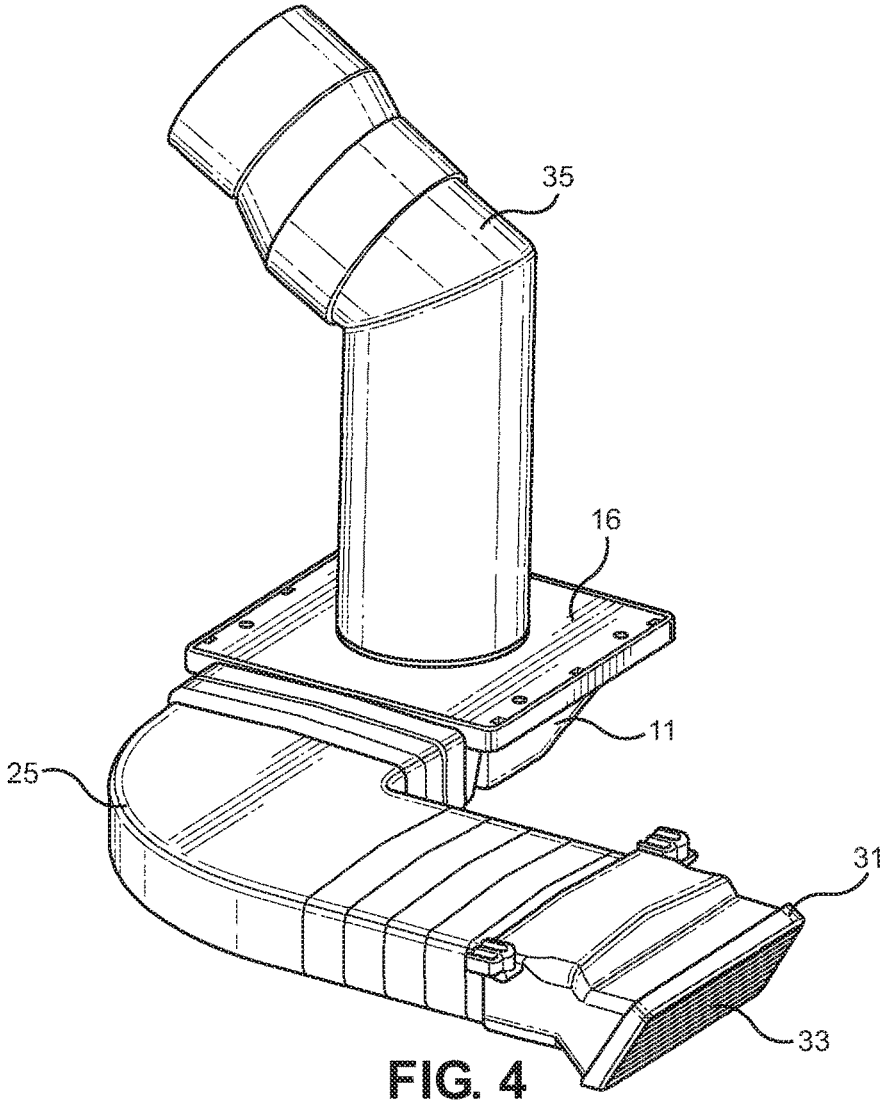
FIG. 4 shows a perspective view of an embodiment of the soffit vent with a ventilation duct attached thereon.

Referring now to FIG. 4, there is shown a perspective view of an embodiment of the soffit vent with a ventilation duct attached thereon. In one embodiment, moisture is pulled into the soffit vent because of a bathroom exhaust fan. Under this embodiment, the bathroom exhaust fan directs steam into a ventilation duct 35. Once the steam is directed into the ventilation duct 35, it is directed into the interface unit 16 and eventually into the elbow unit 11. From the elbow unit 11, the steam is directed into the extension unit 25, then outward through the end unit and the end cap 31 as directed by the plurality of parallel baffles 33.

Figure 5:
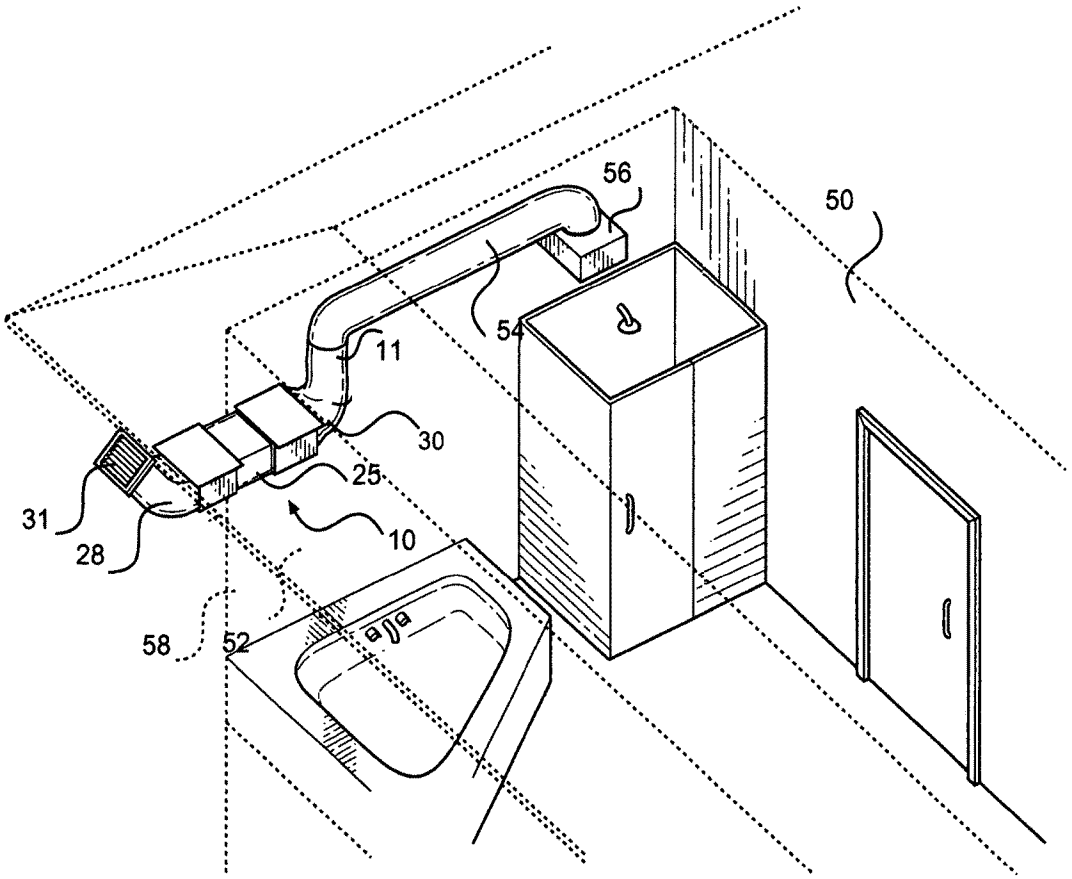
FIG. 5 depicts a transparent overhead perspective view of an alternative embodiment of the invention.
Figure 6:
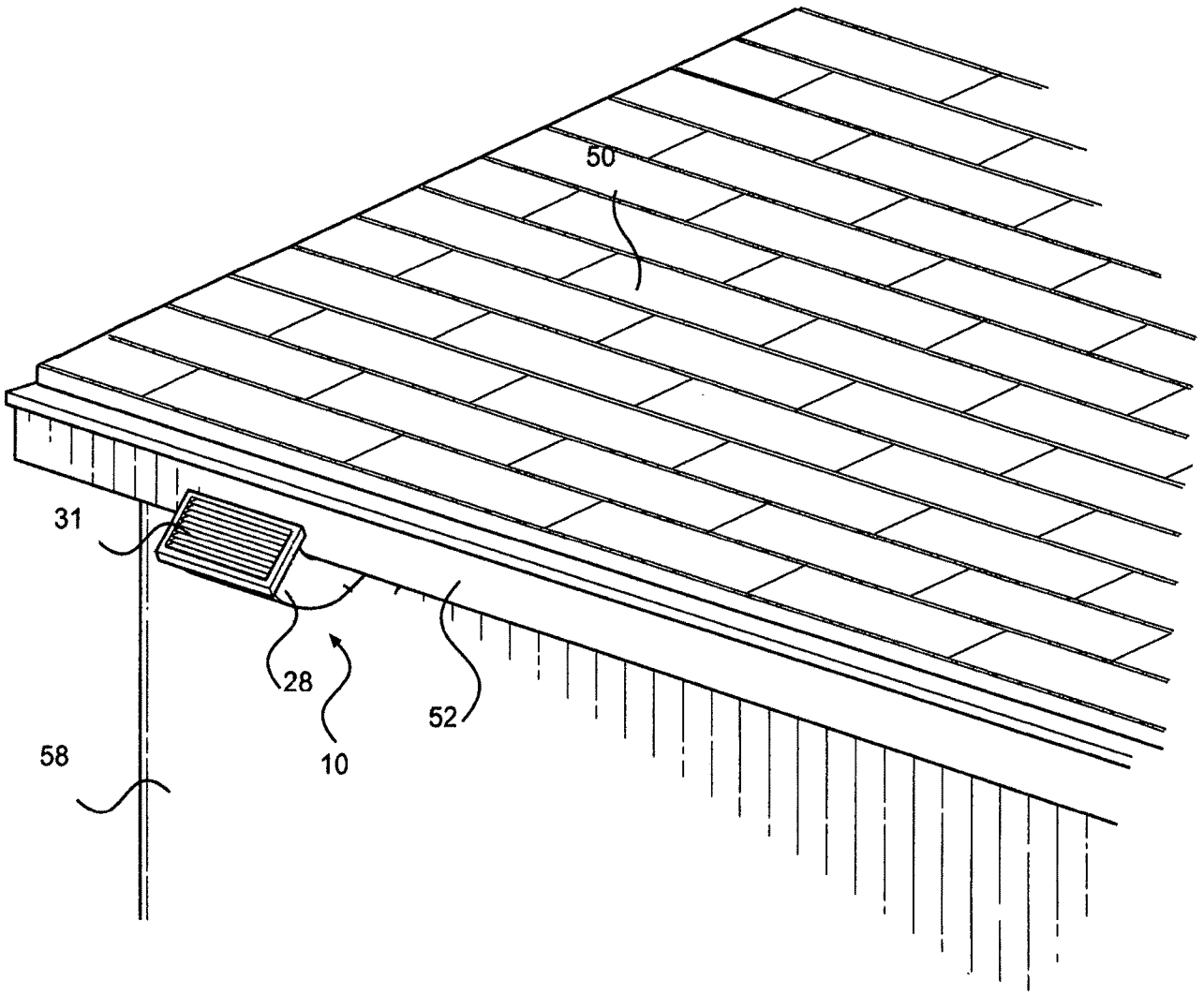
FIG. 6 depicts an exterior view of the embodiment of FIG. 5.

Referring now to FIGS. 5 and 6, there are shown a transparent overhead perspective view and a side exterior perspective view of an alternative embodiment of the soffit vent 10 positioned outside a house 50 underneath a soffit 52. It is contemplated that those of ordinary skill in the art will easily determine the portion of the soffit vent 10 to be disposed on the interior of the house 50, if at all. In the illustrated embodiment, the elbow unit 11 is configured to be attached to an air duct 54 within the house 50. The air duct 54 provides an air pathway between the interior volume of the soffit vent 10 and the bathroom exhaust fan 56. The elbow unit 11 of the soffit vent 10 extends through a side 58 of the house 50 with the end unit 28 extended outwardly in relation to the side 58 of the house 50. Preferably the elbow unit 11 has an interface unit 16 that is circular in shape which allows a circular air duct to be attached thereto, however, other alternative embodiments are constructed of other sizes and shapes to correspond with different types of air ducts. Warm, moist air is forced through the interior volume of the soffit vent 10 from the elbow unit 11 and interface unit 16 to the end unit 28, where warm moist air is dispersed through the end cap 31 of the end unit 28. The end unit 28 and end cap 31 can be positioned around the far edge 60 of the soffit 52 to disperse warm, moist air forced therethrough upwardly away from the soffit 52 and roof overhang of the house 50. This is particularly advantageous because it prevents warm, moist air from being drawn back through as done by conventional soffit vents that release air downwardly from the surface of the soffit 52.

According to the invention, a soffit vent includes an elbow unit defining a cavity having an open upper end configured to receive an interface unit, a flap unit, and an end unit. The interface unit is adapted to secure a ventilation duct. An extension unit extends outwardly from the elbow unit. The flap unit is located between the extension unit and the elbow unit. The flap unit is configured to allow an airflow towards the extension unit while not allowing a backdraft. The end unit is attached to the extension unit opposite the elbow unit. The end unit is configured to enable moisture to escape from the soffit vent into an outdoor environment.

A drip tongue may extend from a bottom surface of the elbow unit. The elbow unit may be defined by two opposing elbow sides extending upwardly from an elbow base, the elbow sides pitched towards a center point.

The interface unit may be configured to rest upon the elbow unit and an interface adapter may extend upwardly from the interface base providing an airway from the elbow unit through the interface unit. The interface unit may contain a plurality of tabs with apertures thereon configured to receive fasteners therethrough.

The extension unit may be an elongated tube configured to be flexibly movable by a user. The extension unit may be an elongated tube containing prefabricated ridges, wherein the prefabricated ridges are configured to allow removal of one or more segments of the extension unit.

Figure 7:
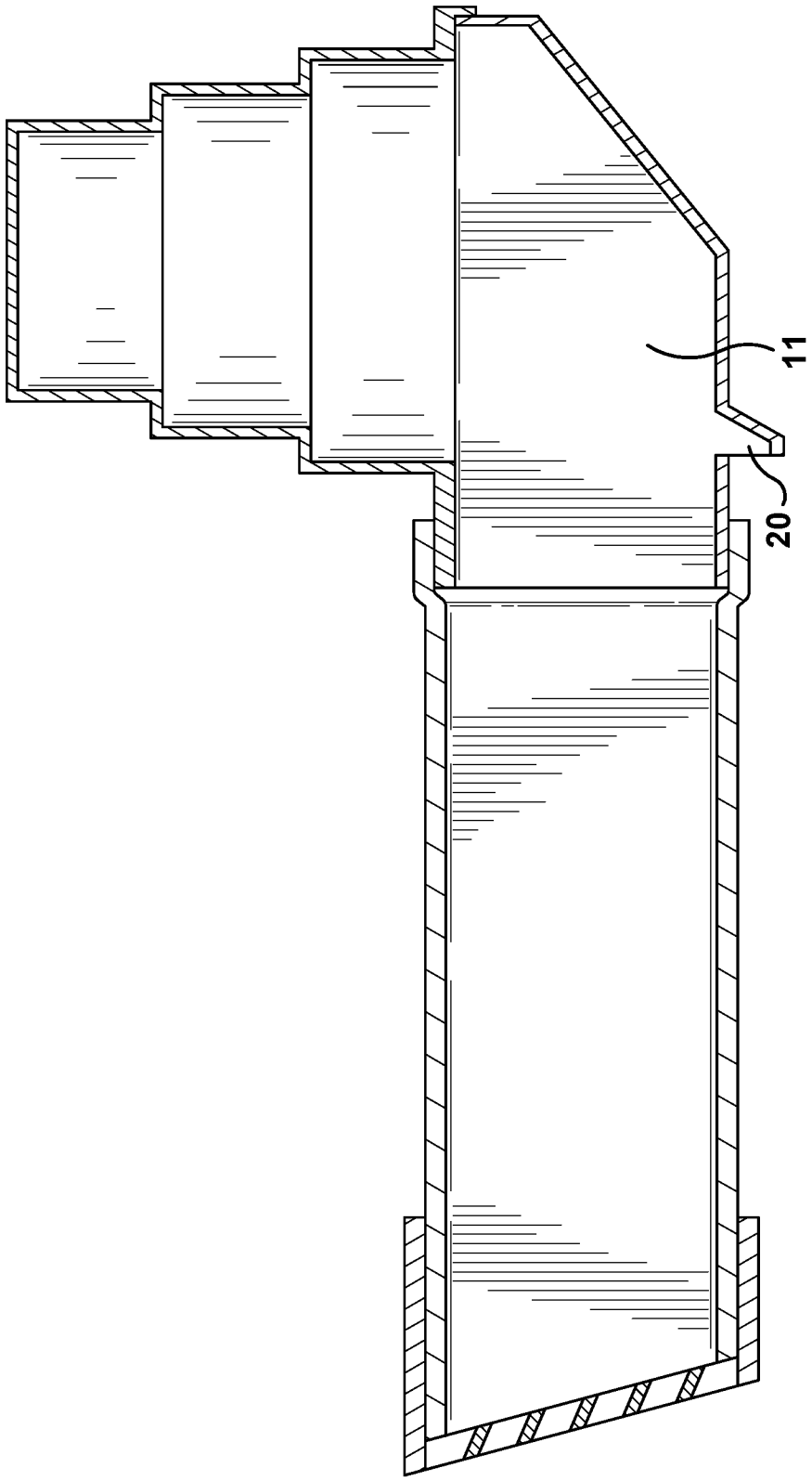
FIG. 7 depicts an internal side view of another embodiment of the soffit vent according to the invention.

There may be at least one barrier in the cavity of the elbow unit causing the flap to be movable in only one direction. The end unit may also include a removable end cap. The end cap may comprise fixed baffles. The fixed baffles may be on a horizontal plane and angled towards an upper surface of the end cap, as shown in FIG. 7. The end cap may be angled downwardly relative to an eave of a roof. The end unit may contain a plurality of slidable fastener interfaces disposed on opposing ends of the end unit. A mesh screen may be positioned between the end unit and the extension unit.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A soffit vent, comprising:

an elbow unit having three side walls and a bottom wall defining a cavity and an open upper end configured to receive an interface unit and an exit end, the elbow unit directing airflow therethrough from a first direction as received from the interface unit to a second direction through the exit end that is perpendicular to the first direction;

the interface unit having a mating portion for coupling to a ventilation duct that directs air from an exhaust fan to the interface unit and the interface unit enclosing the open upper end of the elbow unit;

an end unit coupled to the exit end of the elbow unit and having an outwardly facing surface with a plurality of vent holes positioned adjacent one another for directing air in a common direction;

a flap unit located in the elbow unit, wherein the flap unit is configured to allow an airflow towards the end unit while not allowing a backdraft; and the end unit is configured to enable moisture to escape from the soffit vent into an outdoor environment, wherein the end unit is shaped to extend under a soffit of a house and the end unit is positioned at an outer edge of a soffit and directs air upwardly and outwardly away from the house to deter air from the soffit vent reentering the house through the soffit.

2. The soffit vent of claim 1, further comprising a weep hole extending from the bottom wall of the elbow unit.

3. The soffit vent of claim 1, wherein the side walls of the elbow unit are pitched towards a center point.

4. The soffit vent of claim 1, wherein the interface unit is configured to rest upon the elbow unit and the mating portion of the interface unit is an interface adapter extending upwardly from the interface base providing an airway from the interface unit through the elbow unit.

5. The soffit vent of claim 1, wherein the interface unit includes a plurality of tabs with apertures thereon configured to receive fasteners therethrough to couple the interface unit to the elbow unit.

6. The soffit vent of claim 1, further comprising an extension unit extending outwardly from the exit end of the elbow unit, wherein the extension unit is an elongated tube configured to be flexibly movable by a user.

7. The soffit vent of claim 1, further comprising an extension unit extending outwardly from the elbow unit, wherein the extension unit is an elongated tube containing prefabricated ridges, wherein the prefabricated ridges serve as a guide for cutting the extension unit to the desired length.

8. The soffit vent of claim 1, wherein there is at least one barrier in the cavity of the elbow unit causing the flap unit to be movable in only one direction.

9. The soffit vent of claim 1, wherein the end unit further comprises a removable end cap.

10. The soffit vent of claim 9, wherein the end cap comprises fixed baffles wherein the fixed baffles are angled towards an upper surface of the end cap.

11. The soffit vent of claim 9, wherein the end cap includes a surface that is angled downward relative to an eave of a roof when positioned under a soffit.

12. The soffit vent of claim 1, wherein the end unit contains a plurality of slidable fastener interfaces disposed on opposing ends of the end unit.

13. The soffit vent of claim 1, further comprising an extension unit extending outwardly from the exit end of the elbow unit, further comprising a mesh screen between the end unit and the extension unit.

14. The soffit vent of claim 1, wherein the end unit is configured to enable moisture to escape upwardly and outwardly from the soffit vent away from the soffit of a roof upon which it is installed.

15. The soffit vent of claim 1, wherein the elbow unit directs air from a first vertical direction to a second, substantially perpendicular horizontal direction.

16. The soffit vent of claim 1, wherein the end unit includes an end cap that is removable, said end cap having a plurality of baffles horizontally oriented along a width and angled in an airflow direction to deflect air upwardly away from the end unit.

17. The soffit vent of claim 16, wherein an eave of a roof upon which the soffit vent is positioned defines a first plane and an outwardly facing surface of the end cap defines a second plane, with the second plane being perpendicularly angled downwardly relative to the first plane so that a combination of the baffles and the opening of the end cap deflect air away from an eave of a roof to deter air from reentering a roof through a soffit that is positioned under the eave.

18. The soffit vent of claim 4, further comprising an extension unit extending outwardly from the elbow unit.

19. A soffit vent comprising:

an elbow unit defining a cavity having an opening disposed in an upper end thereof configured for receiving air from a ventilation duct in a first direction and an exit end having an outer periphery for directing air in a second direction that is perpendicular to the first direction;

an end unit coupled to the exit end of the elbow unit around the entire periphery of the exit end, with the end unit being positioned under an eave of a house at an end of an eave of a house and having an open end through which air escapes from the end unit and is directed away from the house, with the open end being positioned at an end of an eave of a house; and the end unit is configured to enable moisture and air to escape from the soffit vent into an outdoor environment while preventing the ingress of pests, said end unit directing air upwardly and away from an eave of a roof so that moisture does not reenter the roof through a soffit in an eave.

20. A soffit vent comprising:

an elbow unit defining a cavity having an opening disposed in an upper end thereof configured for receiving air from a ventilation duct in a first direction and an exit end for directing air in a second direction that is perpendicular to the first direction;

an end unit coupled to the exit end of the elbow unit, with the end unit being positioned under an eave of a house at an end of an eave of a house and having an open end through which air escapes from the end unit and is directed away from the house, with the open end being positioned at an end of an eave of a house;

the end unit is configured to enable moisture and air to escape from the soffit vent into an outdoor environment while preventing the ingress of pests, said end unit directing air away from an eave of a roof so that moisture does not reenter the roof through a soffit in an eave;

an end cap coupled to the open end of the end unit, wherein the end cap has a plurality of baffles horizontally oriented along a width and angled in an airflow direction to deflect air upwardly and outwardly and the end cap faces outwardly away from the eave of the roof; and a flap located adjacent the exit end of the elbow unit and, wherein the flap is configured to allow airflow towards the open end of the end unit while not allowing a backdraft.

* * * * *